United States Patent [19]

DiNardo

[11] Patent Number: 4,871,083

[45] Date of Patent: Oct. 3, 1989

[54] GAS CYLINDER LOCKING MECHANISM

[75] Inventor: John T. DiNardo, Shelby Township, Oceana County, Mich.

[73] Assignee: Chrysler Motors Corporation, Highland Park, Mich.

[21] Appl. No.: 262,388

[22] Filed: Oct. 25, 1988

[51] Int. Cl.[4] ..... B65D 21/02; B65D 41/04

[52] U.S. Cl. ..... 220/23.4; 220/23.2; 220/85 P; 220/85 R; 220/288

[58] Field of Search ..... 220/23.2, 23.4, 69, 220/85 R, 85 P, 288

[56] References Cited

U.S. PATENT DOCUMENTS 3,631,974 1/1972 Schaefer ..... 220/23.4

FOREIGN PATENT DOCUMENTS 2139548 4/1972 Fed. Rep. of Germany ..... 220/23.4

*Primary Examiner*—George E. Lowrance

*Attorney, Agent, or Firm*—Edward A. Craig

[57] ABSTRACT

A gas cylinder locking mechanism is provided to maintain threaded gas cylinders firmly in position on a manifold. The mechanism requires the use of at least two gas cylinders, each of which is provided with a locking tab. The tabs are in interfering relationship with each other to prevent inadvertent unthreading of the gas cylinders.

4 Claims, 1 Drawing Sheet

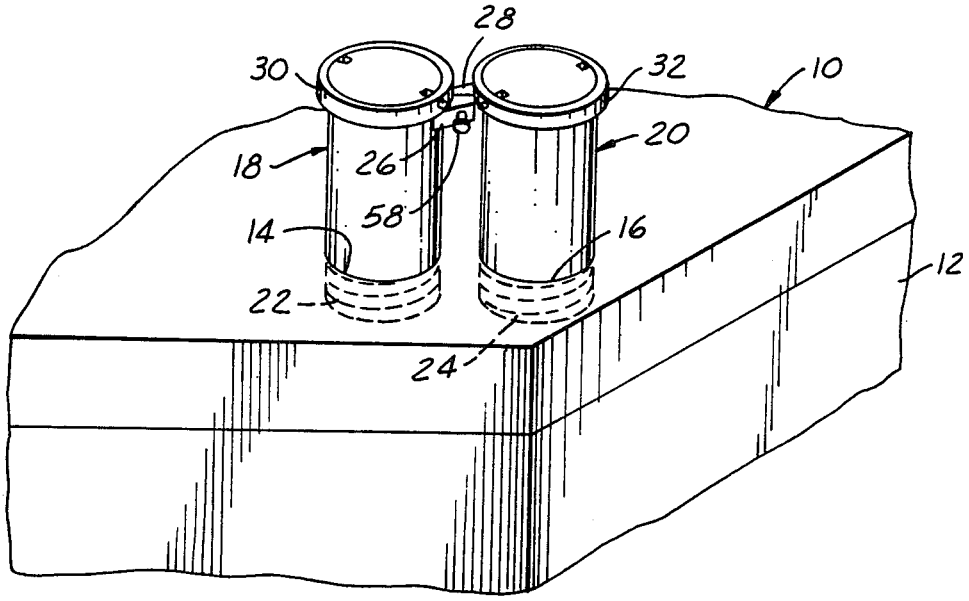
FIG. 1
FIG. 2
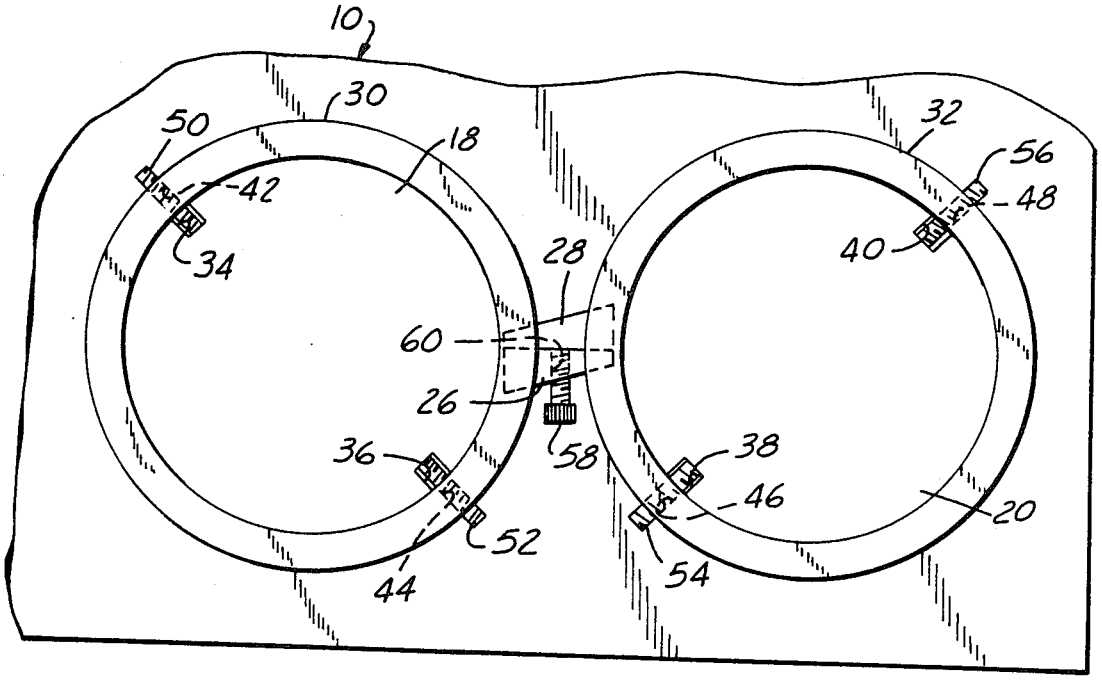

GAS CYLINDER LOCKING MECHANISM

BACKGROUND OF THE INVENTION

1. Field of the Invention

This invention relates to a gas cylinder locking mechanism which prevents gas cylinders which are threadingly received in a manifold from working loose as a consequence of manifold vibration.

2. Description of the Prior Art

Sheet metal stamping presses of the type commonly used in manufacturing processes frequently have moving parts which are manipulated during the stamping process. These moving parts are commonly manipulated by means of compressed gas, usually nitrogen. The source of the compressed gas is cylinders which are filled with compressed nitrogen gas and screwed into place by means of threaded openings provided in a manifold. The openings provide fluid communication to gas actuated mechanisms as necessary. There is a normal attrition of the gas pressure caused by unavoidable leakage. The cylinders are, therefore, removable and may be replaced with fresh cylinders which are properly charged.

A problem has been encountered with the cylinders working loose because of the vibration of the press. This results in excessive gas leakage which causes the actuating pressure to not be what it should be. In accordance with the present invention, a locking mechanism is provided for adjacent cylinders which prevents inadvertent, unwanted, unthreading of the cylinders from the manifold.

SUMMARY OF THE INVENTION

A gas cylinder locking mechanism is provided. A manifold is provided having at least two internally threaded adjacent openings. At least two gas cylinders are provided. Each gas cylinder has an externally threaded portion on one end thereof. Each gas cylinder is threadingly received in one of the openings. Each gas cylinder has a detachable laterally outwardly extending locking tab. The tabs are detached when the gas cylinders are threaded into the openings in the manifold and are attached thereafter.

The tabs of the gas cylinders are in interfering position with respect to each other in a relationship wherein attempted unthreading of one cylinder will result in pressure contact of that cylinder's tab with the tab of the other cylinder causing the other cylinder to more tightly thread into its opening thereby preventing unthreading of the first cylinder and visa-versa.

Preferably, one of the locking tabs is provided with a threaded opening therethrough. A threaded screw is threadingly received in this opening and extends therethrough into pressure contact with the other of the locking tabs to thereby provided initial contact of the tabs. Preferably, the mechanism permitting the detachment and attachment of the tabs includes a locking tab ring. A locking tab extends laterally from this ring. Fastening means are provided to detachably secure the ring to the cylinder. The fastening means preferably comprise at least one notch in the outer periphery of each cylinder. Each ring has a threaded opening therethrough. A threaded screw is threadingly received in this opening and extends therethrough into the notch thereby securing the ring in place on the cylinder.

BRIEF DESCRIPTION OF THE DRAWING

FIG. 1 is a view in perspective of a portion of a manifold with a pair of gas cylinders threaded into openings in the manifold and with the gas cylinder locking mechanism of the present invention in place; and FIG. 2 is top plan view of the structure illustrated in FIG. 1.

DESCRIPTION OF A PREFERRED EMBODIMENT

FIGS. 1 and 2 illustrate the gas cylinder locking mechanism of the present invention. As will be noted, a manifold 10 is supported on structure 12 of a conventional sheet metal stamping press. The manifold 10 has a pair of internally threaded adjacent openings 14, 16. These openings are in fluid communication with the structure to be activated through a controllable valve structure (not shown). A gas cylinder 18, 20 is provided for each of the openings 14, 16. The gas cylinders 18, 20 are normally charged with compressed nitrogen gas. Each gas cylinder 18, 20 has an externally threaded portion 22, 24 on one end thereof. Each of the gas cylinders 18, 20 is threadingly received in one of the internally threaded openings 14, 16.

Each of the gas cylinders 18, 20 has a detachable laterally outwardly extending locking tab 26, 28. These tabs are detached when the gas cylinders 18, 20 are threaded into the openings 14, 16 and are attached thereafter. The tabs 26, 28 are illustratively wedge-shaped.

The mechanism for detaching and attaching the tabs 26, 28 includes locking tab rings 30, 32. Each tab 26, 28 is secured to its respective ring 30, 32 as by welding. The locking tabs extend laterally from the rings. The rings are receivable on the cylinders 18, 20. Each cylinder has a pair of diametrically opposed notches 34, 36, 38, 40. Each ring has a pair of diametrically opposed threaded openings 42, 44, 46, 48 therethrough. A threaded screw 50, 52, 54, 56 is threadingly received in each of the openings 42, 44, 46, 48 and extends therethrough into a notch 34, 36, 38, 40 thereby securing the rings in place on the cylinders. As will be appreciated, the rings may be detached or attached by manipulation of the screws 50, 52, 54, 56.

As will be noted, the tabs 26, 28 of the gas cylinders are in interfering position with respect to each other in a relationship wherein attempted unthreading of one cylinder will result in pressure contact of that cylinder's tab with the tab of the other cylinder causing the other cylinder to more tightly thread into its opening thereby preventing unthreading of the first cylinder. The positionment of the tabs with respect to each other depends upon whether the threads of the openings 14, 16 and corresponding threaded portions 22, 24 of the gas cylinders are right-handed or left-handed threads. Illustratively, the threads are right-handed which means that the gas cylinders 18, 20 are unthreaded in the counterclockwise direction and are threaded into the openings in the clockwise direction. Thus, pressure of the tab 28 on tab 26 (which would result from unthreading of the cylinder 20) will cause the cylinder 18 to thread more firmly into the opening 14. This prevents unthreading of the cylinder 20. Similarly, if the cylinder 18 is moved in a counterclockwise direction, the tab 26 will contact the tab 28 and cause the cylinder 20 to thread more firmly into its opening, thereby preventing unthreading of the cylinder 18. If left-hand threads were used, the position of the tabs 26, 28 would need to be reversed.

A set screw 58 is provided to maintain initial pressure contact of the tabs 26, 28. An internally threaded opening 60 extends through the tab 26 and threadingly receives the screw 58 which extends therethrough into pressure contact with the tab 28 to provide the desired initial contact of the tabs. This avoids any small amount of play which might otherwise exist between the tabs 26, 28 and results in firmly maintaining the cylinders 18, 20 in the desired positions.

As will be appreciated, additional gas cylinders could be provided in the manifold 10 in line with the gas cylinders 18, 20. It would be necessary to provide additional locking tab structures between adjacent cylinders to result in the desired locking of the gas cylinders in place.

I claim:

1. A gas cylinder locking mechanism comprising a manifold, the manifold having at least two internally threaded adjacent openings, a least two gas cylinders, each gas cylinder having an externally threaded portion on one end thereof, each gas cylinder being threadingly received in one of said openings, each gas cylinder having a detachable laterally outwardly extending locking tab, said tabs being detached when the gas cylinders are threaded into said openings and attached thereafter, the tabs of the gas cylinders being in interfering position with respect to each other in a relationship wherein attempted unthreading of one cylinder will result in pressure contact of that cylinder's tab with the tab of the other cylinder causing the other cylinder to more tightly thread into its opening thereby preventing unthreading of said one cylinder and visa-versa.

2. A gas cylinder locking mechanism as in claim 1, further characterized in that one of the locking tabs is provided with a threaded opening therethrough, a threaded screw threadingly received in said last-mentioned opening and extending therethrough into pressure contact with the other of the locking tabs to thereby provide initial contact of the tabs.

3. A gas cylinder locking mechanism as in claim 2, further characterized in that each of the cylinders has a locking tab ring, a locking tab extending laterally from the ring, and fastening means detachably securing the ring to the cylinder.

4. A gas cylinder locking mechanism as in claim 3, further characterized in that said fastening means comprises at least one notch in the outer periphery of each cylinder, each ring having a threaded opening therethrough, and a threaded screw threadingly received in said last-mentioned opening and extending therethrough into the notch thereby securing the ring in place on the cylinder.

* * * * *